US005740633A

United States Patent [19]

Champagne

[11] Patent Number: 5,740,633

[45] Date of Patent: Apr. 21, 1998

[54] SYSTEM FOR AFFIXING A GUTTER SYSTEM

[76] Inventor: Wendel James Champagne, 21823 W. Champagne Cir., Tomball, Tex. 77375

[21] Appl. No.: 555,885

[22] Filed: Nov. 13, 1995

[51] Int. Cl.[6] ..... E04D 13/06

[52] U.S. Cl. ..... 52/11; 52/15; 52/58

[58] Field of Search ..... 52/11, 15, 58

[56] References Cited

U.S. PATENT DOCUMENTS

| | | | |
|---|---|---|---|
| 3,296,749 | 1/1967 | Gotter | 52/11 |
| 3,333,803 | 8/1967 | Landis | 52/11 X |
| 3,344,562 | 10/1967 | Miles et al. | 52/11 |
| 3,550,381 | 12/1970 | South | 52/11 X |
| 3,612,453 | 10/1971 | Zimmer | 52/11 X |
| 4,195,452 | 4/1980 | Smith et al. | 52/11 |
| 4,241,548 | 12/1980 | Rowe | 52/11 |
| 4,271,643 | 6/1981 | Sweers | 52/11 |
| 4,300,319 | 11/1981 | Frost et al. | 52/11 |
| 4,705,242 | 11/1987 | Yost | 52/11 X |
| 4,713,915 | 12/1987 | Sweers | 52/11 |
| 4,912,888 | 4/1990 | Matrin | 52/11 X |

*Primary Examiner*—Carl D. Friedman
*Assistant Examiner*—Yvonne Horton-Richardson

[57] ABSTRACT

An interlocking gutter retaining system for mounting a rain gutter under the eaves of a pitched roof includes a specially designed retainer member that is adapted to be affixed to the fascia board directly under the eaves. The retainer member is provided with engaging means, including a receiving channel, into which the rear wall of a standard rain gutter is inserted. The receiving channel is adapted so as to securely engage the gutter such that it can be pulled out only with significant force and/or the use a tool specially designed for the purpose. To maximize the engagement of the gutter within the securing channel, the rear wall of the gutter is crimped along its lateral edge.

8 Claims, 3 Drawing Sheets

SYSTEM FOR AFFIXING A GUTTER SYSTEM

FIELD OF THE INVENTION

The present invention relates to a system and apparatus for affixing a gutter system to a building. More specifically, the present invention relates to an interlocking system for affixing gutters to the eaves of a building that obviates the need for using nails or screws within the gutter itself, and to the structure installed according to the system, both preassembly and as assembled.

BACKGROUND OF THE INVENTION

Property owners have historically struggled with minimizing the effect weather elements have on their buildings. One of the most destructive of these elements is water, which can cause the decay of wood, or damage paint and cause rusting of building fixtures by carrying corrosive substances along the sides of buildings. However, by channeling the water away from the structure, building owners have reduced the damage cause by water. One of the most common methods of performing this channeling is with the use of a gutter system.

In the past, gutters have been attached by nailing the gutter directly to the building. Builders typically used a spike and ferrule system, in which a narrow, tubular spacer, the ferrule, was placed between the front face of a gutter and its rear face, ensuring that the front face remained at a uniform distance from the rear face. A spike or long nail, was then punched through the outside of the front face of the gutter, through the ferrule, through the back face of the gutter, and into the wall or fascia of the structure.

At best, using the nail in this manner would often ruin the finished appearance of the gutter. In addition, the gutter being installed would necessarily end up with its front face tilted forward towards the ground. In such a configuration, the captured rainwater and other material tends to pool along the outer edge of the gutter. The weight of this material creates a moment at the point of insertion of the nail, resulting in a force pulling the gutter away from the wall. Further, while this manner of installation has the effect (at least temporarily) of securing the gutter in place, it does not ensure that water will not run behind the gutter. In any structure where water is allowed to run and collect behind the gutter, eventually the integrity of the wood begins to weaken and the moment forces referred to above slowly pull the nail and the gutter away from the building. In periods of adverse weather, high winds can accelerate the process by getting behind the gutter and forcing it completely away from the building.

The utilization of gutter hangers is the most common way in which installers have tried to improve the integrity and life of gutter systems. In this application, a modified spacer is used, shaped like a flat plate, with both ends mined upward. One end of this spacer is inserted under the lip of the front face of the gutter, while the second end, with a pre-punched nail hole, is placed against the rear face of the gutter. A nail or screw is then inserted through the nailhole, through the rear face of the gutter, and into the building wall. A variation of this method includes placing the second end of the spacer over the top of the rear face of the gutter. The spacer is then nailed directly into the roof decking of the building or to the face of the wall, under any existing shingles. These methods of installation provide the advantage of effectively integrating the spike with the ferrule of the previous invention, thus eliminating the unsightly appearance previously created by installing the nail or screw through the front face of the gutter. However, they did not address the problem of collection of water behind the gutter, nor relieve the moment created by the weight of the water pooling outwardly within the gutter.

Because of the problems which have been associated with traditional methods of installing gutters, there has remained a need for a strong, sturdy gutter system. It is desirable that installation be easy, while ensuring that any interlocking aspect of the system is not compromised during periods of high winds or other adverse weather conditions. Preferably, such a system should redistribute the water and other material captured within the gutter, such that all moments that could result are negated.

SUMMARY OF THE INVENTION

The present invention embodies a system for affixing a rain gutter to the fascia board under the eaves of a building having a pitched roof. As a first element of the system, the invention provides a retainer member that is adapted to be affixed to the fascia board of the building for separate mounting under the roofing and can be fastened to the roof decking and/or face of the structure. The retainer member comprises a planar strip of monolithically formed resilient material, which is formed in such a manner that there are first, second and third planar portions. The first and third planar portions are at right angles to each other, so that they may fit along and around the outside edge of a fascia board of a building. The second planar portion of the planar strip is shaped such that it creates a tight channel with the third planar portion. The second planar portion has a hooked area at its distal end, and is adapted to receive the rear wall of a standard gutter.

As a second element of this system, the invention provides engaging means that are adapted to engagingly receive, retain and support a rain gutter against the fascia board directly under the roof eave. The engaging means are associated with the retainer member and, preferably, is build directly into the retainer member. The engaging means is designed to permit a standard rain gutter to be snapped into place and held securely against the fascia board. The engaging means includes a receiving channel, preferably directly formed from a portion of the retainer member, that is adapted to receive and engage the rain gutter after it has been inserted into the channel such that the gutter can move freely back and forth within the channel in a lateral direction but will sufficiently engage the gutter such that it can be pulled out of the channel only with significant force and/or the use of a tool specially designed for the purpose. To maximize the engagement of the gutter within the securing channel of the engaging means, it is preferred that the rear wall of the gutter be crimped along its lateral edge. Alternatively, the rear wall of the gutter can be bent in on itself along the top edge.

The present invention also includes a spacer, with a first section fitting inside the channel created by the second and third planar portions of the planar strip and a second section adapted to span the distance between the front and rear walls of a standard gutter. The second section further comprises a hooked portion for matriculation with the lip of the front wall of the gutter.

In the preferred forms of the invention, all of the members in question are monolithically formed of suitable sheet-like material, such as polyvinyl chloride, high density polyolefin, aluminum or steel.

These and other objects, features, and advantages of the invention will be further elucidated by the following detailed description, the drawings, and the claims.

DETAILED DESCRIPTION

Figure 1:
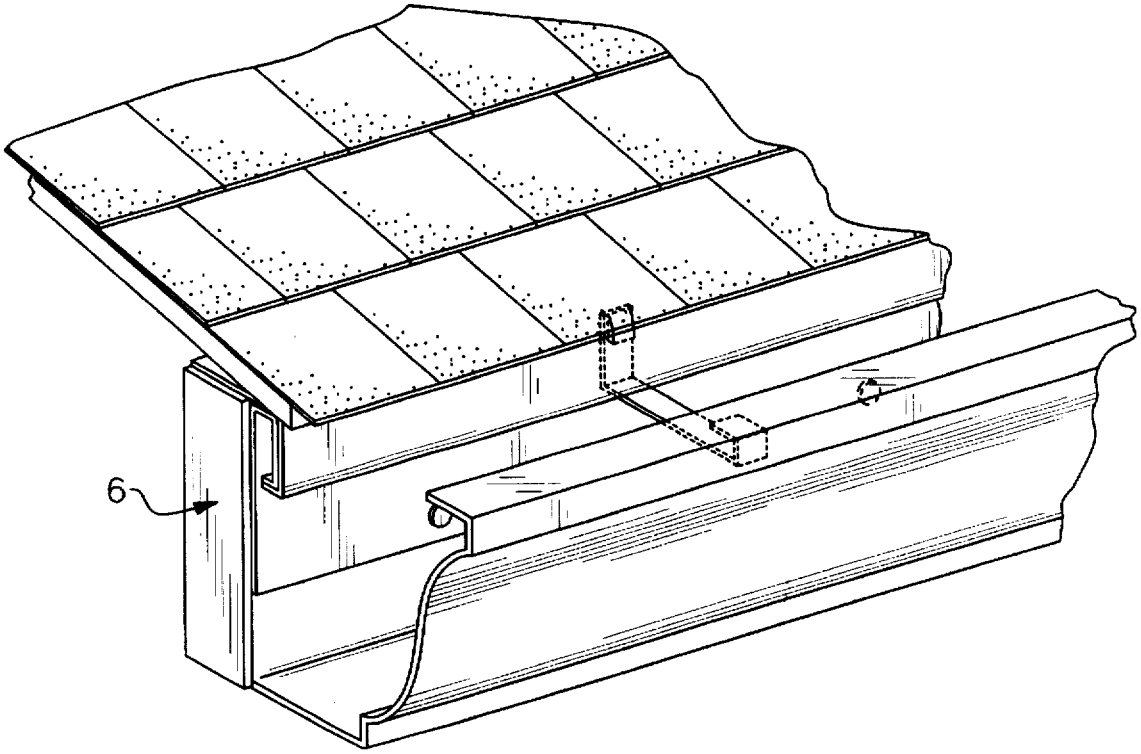
FIG. 1 shows a perspective view of the gutter system installed on the fascia board of a building.
Figure 2:
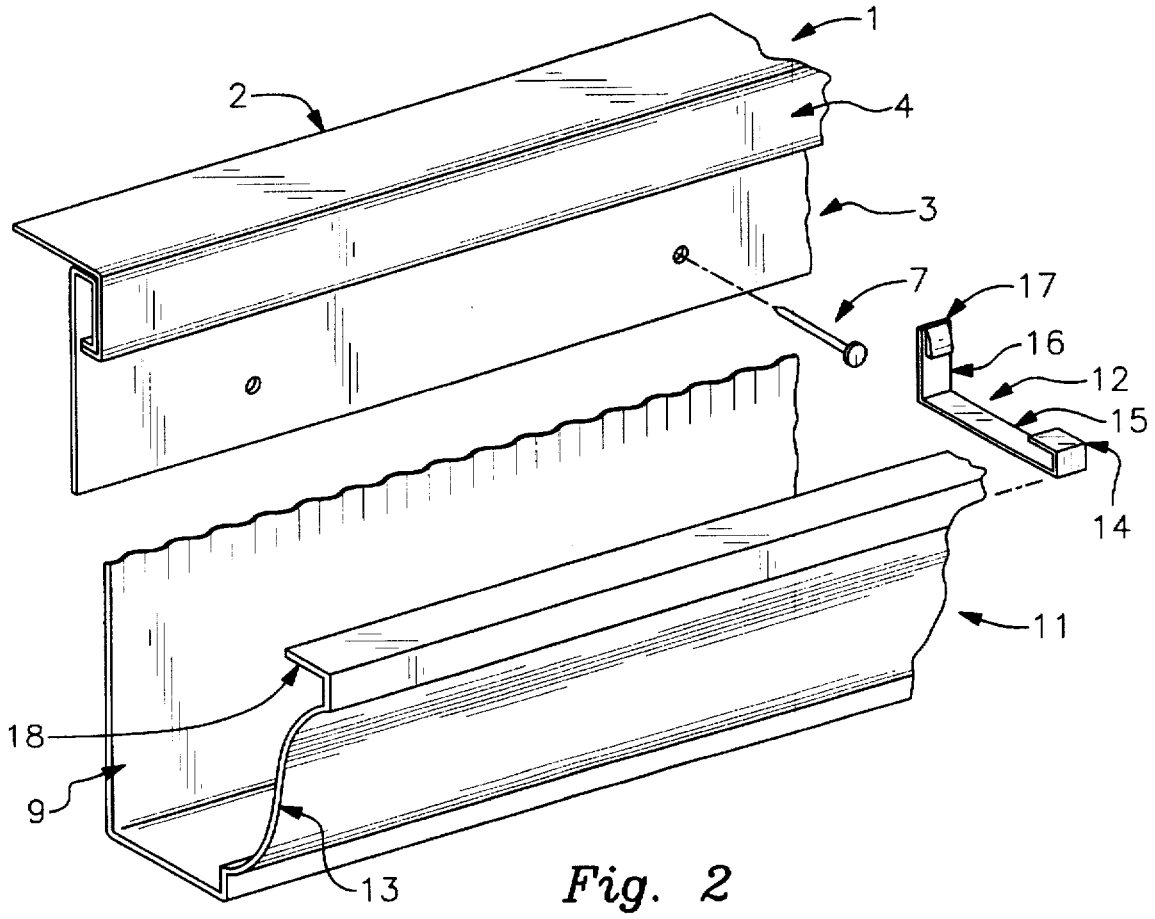
FIG. 2 shows an exploded perspective view of the system before installation on the fascia board.
Figure 3:
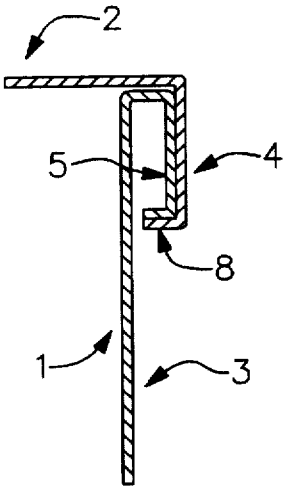
FIG. 3 shows a side view of the retaining member, detailing the tight channel for receiving the rear wall of the gutter, and the hooked portion for matriculation with the crimped portion of the gutter's rear wall.

Referring to FIGS. 1, 2 and 3, the invention will be described with particular reference to the preferred embodiment shown in the drawings. It will be understood by a person having appropriate skill in this art that a number of different embodiments, each having practical application, are possible. With reference to the embodiment shown in the drawings, retaining member 1 has a horizontal section 2, a vertical section 3, a return 4, and a tight channel 5. The vertical section 3 is secured in place against the vertical face of fascia board 6 of a building. This vertical section 3 is affixed to the fascia board 6 such that the horizontal section 2 of the retaining member is inserted under the building roof deck 7. This further secures the retaining member 1 and positions it to mount the rain gutter appropriately under the eaves of the roof.

Figure 4:
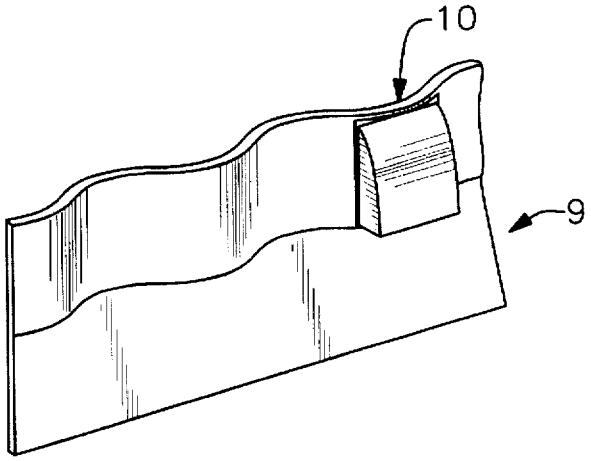
FIG. 4 shows a detail of a crimp in the rear wall of the gutter.

FIG. 3 provides a detailed view of return 4 and tight channel 5. As can be seen with reference to FIG. 3, the return 4 is shaped such that it creates a tight channel 5 in combination with vertical member 3. Preferably, the return 4 contains a hooked portion 8. The rear wall 9 of a standard rain gutter 11 is inserted into the tight channel 5 of the retaining member 1. In the preferred embodiment (see FIG. 4), the rear wall 9 contains crimps 10 at regularly spaced intervals along its length. These crimps 10 matriculate with the hooked portion 8, after the rear wall 9 is inserted into the tight channel 5, thereby securing the gutter 11 within the retaining member 1. As will be appreciated, the gutter is engaged within the tight channel 5 in such a manner that the gutter can move freely back and forth within the channel in a lateral direction, but will be effectively secured against removal in a downward direction. Removal will necessitate the use of a tool designed for such purpose which can force the channel open sufficiently to move the projections away from the crimped areas of the gutter.

Figure 5:
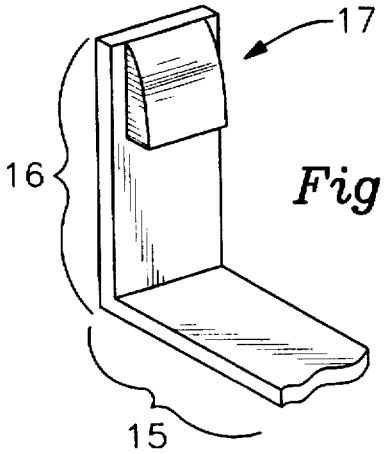
FIG. 5 shows a detail of the crimped portion of the spacer element of the system.

Referring also to FIG. 5, a spacer member 12 can be utilized to ensure that the front wall 13 of the gutter 11 remains at a constant and consistent spaced relationship with the rear wall 9. The spacer member has a curved section 14, a horizontal section 15 and a vertical section 16. The vertical section 16 preferably contains a crimp 17 or a ridge along the top edge. As an alternative, for aluminum or other metals that can be re-shaped with relative ease, the top edge of the gutter back wall can be bent in on itself.

The spacer member 12 is inserted into the gutter 11 as follows: the curved portion 14 is inserted into the lip 18 of the front wall 13 of the gutter 11. The horizontal section 15 is positioned such that it spans the distance between the front wall 13 and the rear wall 9 of the gutter 11. The vertical section 16 is inserted into the tight channel 5 of the retaining member 1, such that the vertical section 16 lies against and along the rear wall 9 of gutter 11. In this manner, the crimp 17 matriculates with the hooked portion 8, such that the spacer member 12 remains securely in placed. A plurality of such spacer members 12 is inserted into the gutter 11 in a similar manner along regularly spaced intervals of the gutter's length.

Although the invention has been described in conjunction with the specific embodiment shown in the drawings, it will be evident that many alternatives and variations of the details disclosed can be made in light of the forgoing description. Accordingly, the invention is intended to embrace all the alternatives and variations that fall within the spirit and scope of the appended claims.

What is claimed is:

1. An interlocking gutter retaining system for mounting a rain gutter under the eaves of a pitched roof, comprising:

A retainer member affixed to the fascia board of a building for separate mounting under the roofing, said retainer member comprising first, second and third portions, wherein said first and third portions are transverse to each other, and lie along the top and outer face, respectively, of the fascia board, and said second and third portions cooperating to form a downwardly opening channel for receiving and retaining a rear wall of the gutter; and Engaging means associated with said retainer member to engagingly receive, retain and support the gutter against the fascia board directly under the roofing, said engaging means permitting the gutter to move freely within said channel in a lateral direction but resisting withdrawal of the gutter from said channel.

2. The gutter retaining system of claim 1 wherein said first portion of said retainer member extends outwardly beyond said third portion, and said second portion depends downwardly from said first portion generally parallel to but spaced from said third portion.

3. The gutter retaining system of claim 2, wherein said second portion includes a projection extending rearwardly toward said third portion for engaging the rear wall of the gutter upon insertion thereof into said channel, said rearward projection permitting the gutter to move freely within said channel in a lateral direction but resisting withdrawal of the gutter from said channel.

4. The gutter retaining system of claim 3, wherein said rearward projection comprises a hook inclined upwardly and inwardly from said second portion.

5. The interlocking gutter retaining system of claim 1, further comprising a spacer having a vertical section, a horizontal section and a curved section, said vertical section juxtaposed against the rear wall of said gutter and disposed inside of said channel, and wherein said horizontal section spans the distance between the rear wall and a front wall of said gutter.

6. The gutter retaining system of claim 5, wherein said front wall of said gutter includes a lip projecting inwardly toward said rear wall of said gutter for engagement with said curved section of said spacer.

7. The gutter retaining system of claim 1, wherein said first, second and third portions are formed in a planar shape.

8. An interlocking gutter retaining system for mounting a rain gutter under the eaves of a pitched roof, comprising;

A retainer member affixed to the fascia board of a building for separate mounting under the roofing, said retainer member comprising first, second and third portions, wherein said first and third portions are transverse to each other, and lie along the top and outer face, respectively, of the fascia board, and said second and third portions cooperating to form a downwardly opening channel for receiving and retaining a rear wall of the gutter;

Wherein said first portion of said retainer member extends outwardly beyond said third portion, and said second portion depends downwardly from said first portion generally parallel to but spaced from said third portion;

Wherein said second portion includes a rearward hook projection inclined upwardly and extending rearwardly toward said third portion for engaging the rear wall of the gutter upon insertion thereof into said channel, said hook projection permitting the gutter to move freely within said channel in a lateral direction but resisting withdrawal of the gutter from said channel.

* * * * *